United States Patent [19]

Shiller et al.

[11] 4,069,513

[45] Jan. 24, 1978

[54] FORM-FITTING TROUSERS

[76] Inventors: Peggy Shiller; Sidney Shiller, both of Sleepy Hollow Road, Scarborough, N.Y. 10510

[21] Appl. No.: 723,689

[22] Filed: Sept. 16, 1976

[51] Int. Cl.[2] ..... A41D 1/06

[52] U.S. Cl. ..... 2/227; 2/409; 128/519

[58] Field of Search ..... 2/227, 228, 237, 221, 2/211, 409; 128/519

[56] References Cited

U.S. PATENT DOCUMENTS

| | | | |
|---|---|---|---|
| 3,068,871 | 12/1962 | Rapp | 2/227 X |
| 3,127,896 | 4/1964 | Puliafico | 2/227 X |
| 3,214,770 | 11/1965 | Smith | 128/519 |
| 3,234,947 | 2/1966 | Bergstein | 2/227 X |
| 3,246,342 | 4/1966 | Pagano | 128/519 |
| 3,417,756 | 12/1968 | Leventhal | 128/519 |

*Primary Examiner*—H. Hampton Hunter

*Attorney, Agent, or Firm*—Burgess, Dinklage & Sprung

[57] ABSTRACT

There is provided an outer garment including an outer portion intended to embrace the lower torso, an internal body hugging portion made of power net having front and rear sections, means securing the outer portion to the internal portion approximately about the waistline and longitudinally downwardly from the waistline approximately centrally of the front of the garment, and means in the area of the crotch securing the front and rear sections of the internal portion in relative positions to one another and defining individual leg holes for the wearer's feet. Advantageously the outer portion is a pair of stretch trousers knit of textured polyester multifilament yarns, the power net is more stretchable longitudinally than transversely and the power net is also secured to the rear of the trousers along a central longitudinal line. The power net, which front and rear extends to the crotch, may be stitched fully lengthwise to meet at a point or be joined into a full crotchpiece.

7 Claims, 9 Drawing Figures

FORM-FITTING TROUSERS

The present invention relates to a novel form-fitting garment which serves to slim, firm and support the wearer.

In wearing form-fitting garments such as stretch trousers many men and women exhibit bulges due to overweight. This has therefore often served as a deterrent to the wearing of such garments.

The unsightliness, real or imagined, can be diminished or eliminated by the wearing of a stretchable support structure such as a girdle or other undergarment but such structures are relatively heavy and their presence is apparent even from outside, particularly in view of their relative bulk. Moreover, many individuals have a psychological reluctance to purchase and/or wear such support structures per se, notwithstanding their advisability.

It is accordingly an object of the invention to provide a garment which is form fitting and shaping without the need for a separate supporting undergarment.

These and other objects and advantages are realized in accordance with the present invention pursuant to which there is provided an outer garment including an outer portion intended to embrace the lower torso and an internal body hugging portion made of power net, the internal portion extending to the crotch being secured to the outer portion approximately about the waistline and longitudinally downwardly from the waistline approximately centrally of the front of the garment.

Advantageously the internal portion is also secured to the outer portion approximately centrally of the rear of the garment and the power net is more stretchable longitudinally than transversely.

In a preferred embodiment the garment is a pair of trousers, e.g. stretch pants made of a double knit fabric of textured polyester yarn, the fabric being highly stretchable so as to be form fitting, but having a lower power factor than the internal portion. The internal portion is knit or woven of highly stretchable yarns and comprises a fabric such as is usually employed for girdles, i.e. though highly stretchable it exhibits a comparatively high contractile force when stretched so as to hold in the abdomen and posterior and provide a body-shaping function, in contrast with the outer portion which primarily exerts a body-comforting function.

Surprisingly, it has been found that a superior slimming, firming and supporting action without external visibility is achieved by having the internal portion stitched to the external portion downwardly from the waist along the center of the front and, desirably, down the center of the rear as compared with stitching of the two at the sides. In the instant particular construction, the garment has the greatest slimming effect consistent with that freedom of movement usually associated with stretch pants if the power net is more stretchable longitudinally than transversely, i.e. if the contractile force is greater transversely than longitudinally.

The outer garment itself is preferably a pair of trousers but it could equally be a pair of shorts, a jumpsuit or even a skirt or dress with the inner portion secured at the waist, preferably in a single stitching operation primarily intended for some other purpose, e.g. forming a waistband or waist hem. The maximum need for and effect of the inner portion is exhibited when the garment is form-fitting and thus preferably the outer garment is stretchable over the lower torso. To this end the fabric may be made of any stretchable fabric such as double knits, jerseys, stretchable denims, weaves of stretchable yarns, and the like. Any yarns may be used in making such fabrics but excellent results are achieved with false twist textured multifilament yarns of polyester, nylon, or the like, ranging in denier from about 50 to 300.

The front and rear of the inner portion may be connected permanently or by snap action as in a conventional undergarment with separate leg holes separated by a crotchpiece or the front and rear may just meet at a point so as to define leg holes separated by less than a full, i.e. a partial crotchpiece. The inner portion may be of constant height or it may be contoured so as to be longer in the front and/or rear for a V-shaped effect.

The inner portion can be sewn into the outer portion by longitudinal lines of stitching which may also serve to hold together panels making up the garment so as to preclude additional sewing operations. The longitudinal sewing lines should extend below the posterior and, when the garment includes a pair of trousers, the lines may run down to the crotch, thereby preventing any possible movement of the inner portion during wear.

The lower edge of the inner portion does not have to be a selvage or be hemmed provided it will not unravel. This contributes to the effect that the location of the bottom of the inner portion is substantially invisible from the outside when the garment is being worn. This is further aided by the fact that, since the stretch garment itself exerts some slimming effect, thinner power nets can be employed and the wearer inspecting the power net can see it is much lighter in weight and construction than a girdle, for example. The external visibility can be further minimized by breaking up the outer surface of the outer garment at least in the vicinity of the bottom of the inner portion, as by providing a three-dimensional or pebbled effect, printing a multi-colored pattern, providing stripes, or the like.

The size of the inner portion relative to the outer portion will of course depend upon their relative degrees of stretch, etc.

The invention will be further described with reference to the accompanying drawings, wherein.

Figure 1:
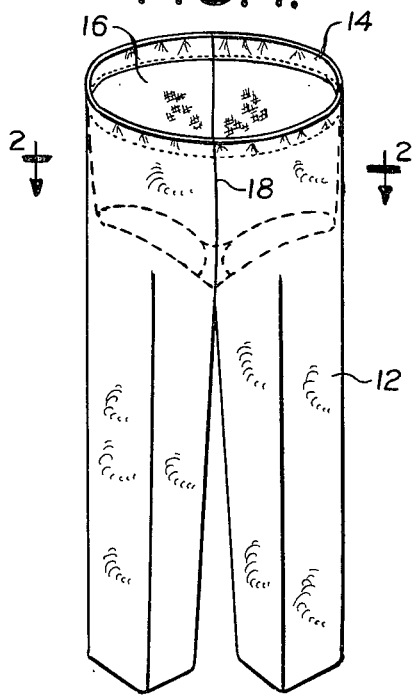
FIG. 1 is a perspective view of a pair of slacks provided with one embodiment of an internal body hugging portion in accordance with the present invention.
Figure 2:
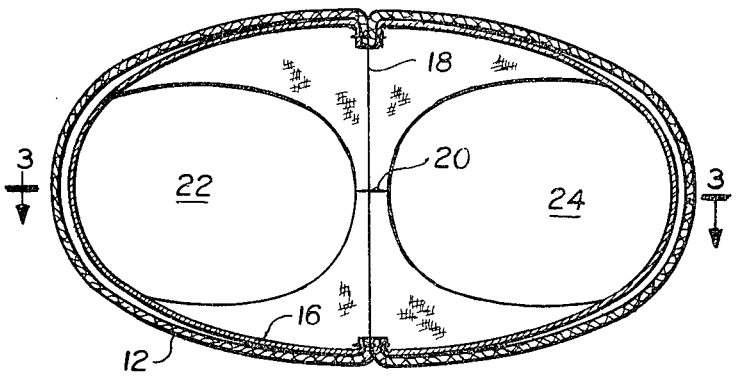
FIG. 2 is a section taken along line 2—2 of FIG. 1.
Figure 3:
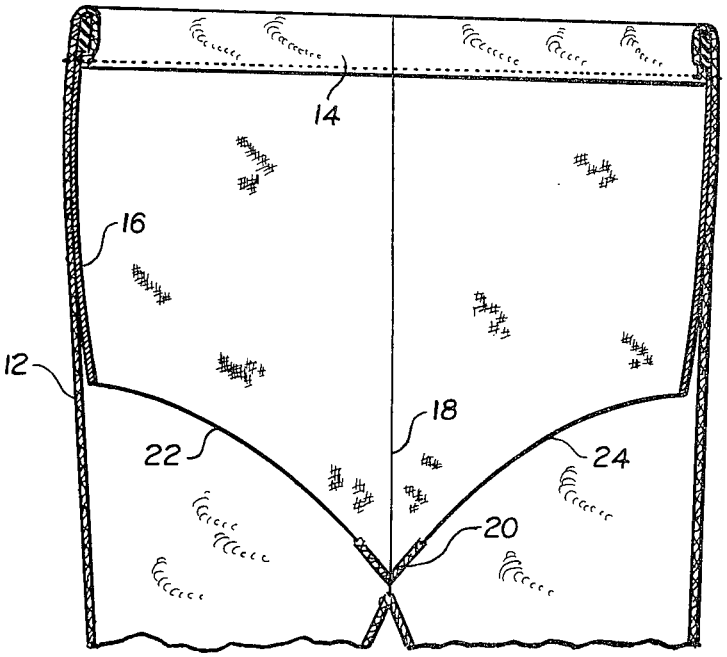
FIG. 3 is a section along line 3—3 of FIG. 2.

Referring now more particularly to the drawings, in FIGS. 1,2 and 3 there is shown a pair of stretch slacks 12 provided with a waistband 14 into which there is sewn the top of an internal body hugging member 16 made of material such as power net. The member 16 is stitched to the slacks 12 along a line 18 which extends from the front center, along the crotch to the rear center. The power net may be made of a single cylindrical tube of fabric with some stitch lines or of panels sewn together particularly across the crotch as at 20; the configuration is such, however, that individual legs holes 22, 24 are defined thereby.

The power effect of the member 16 can be less than an ordinary girdle since the slacks theremselves contribute to support because they are form fitting and stretchable. In addition, it need not be excessively tight about the thighs as is ordinarily required to prevent riding up; the longitudinal seams 18, 20 fore and aft overcome this tendency to ride up so it need not be served by the otherwise tight, cutting grip about the thighs. This also permits the greater stretch of the power net to be in longitudinal direction rather than transversely which facilitates bending, stooping, and the like.

Figure 4:
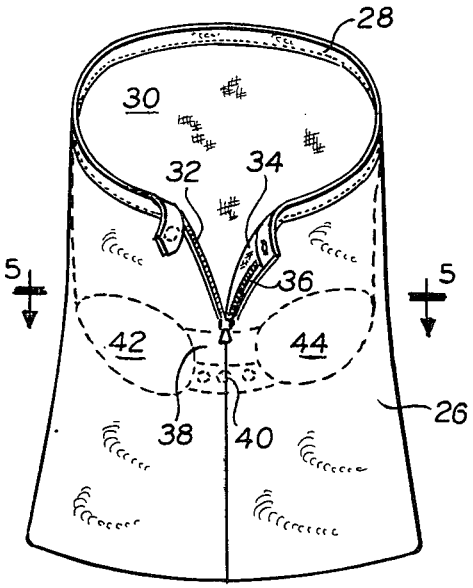
FIG. 4 is a perspective view of a skirt provided with an alternate embodiment of an internal body hugging portion.
Figure 5:
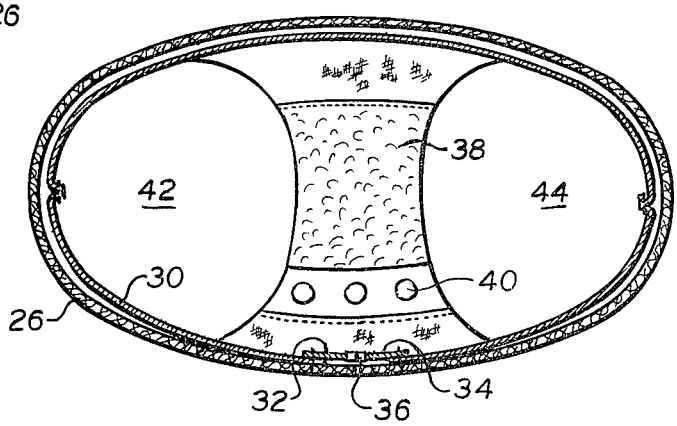
FIG. 5 is a section along line 5—5 of FIG. 4.

In FIGS. 4 and 5 the outer garment is a skirt 26 into whose waistband 28 there is sewn the top of body hugging member 30. The member 30 is sewn longitudinally to the skirt 26 only in the front along lines 32, 34 on the sides of the zipper 36; there is no rear joinder. To serve as an additional anchor to prevent riding up, there is provided a crotchpiece 38 having snaps 40 and defining separate leg holes 42, 44.

Figure 6:
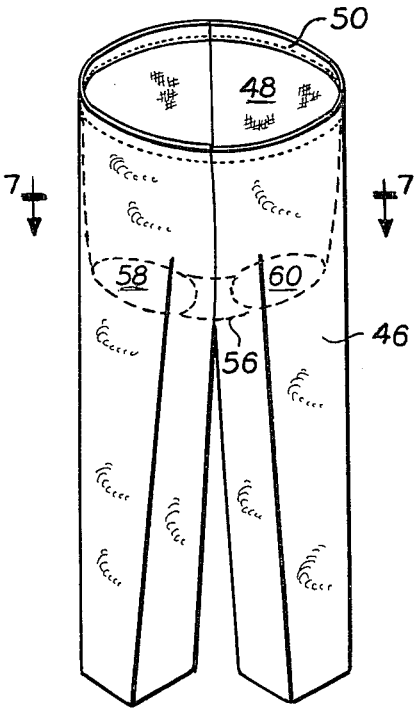
FIG. 6 is a perspective view of a pair of slacks with still another embodiment of internal body hugging portion.
Figure 7:
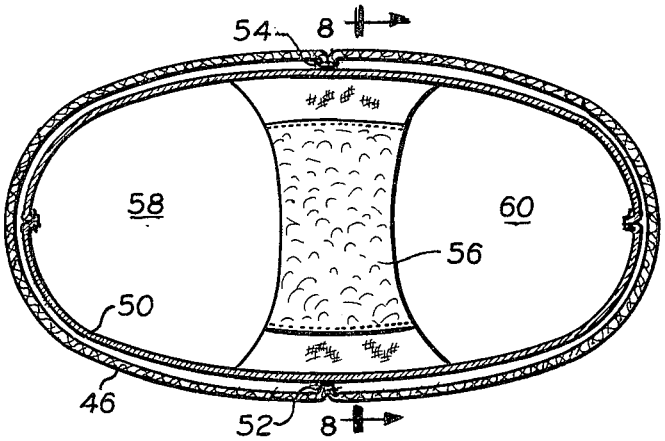
FIG. 7 is a section taken along line 7—7 of FIG. 6.
Figure 8:
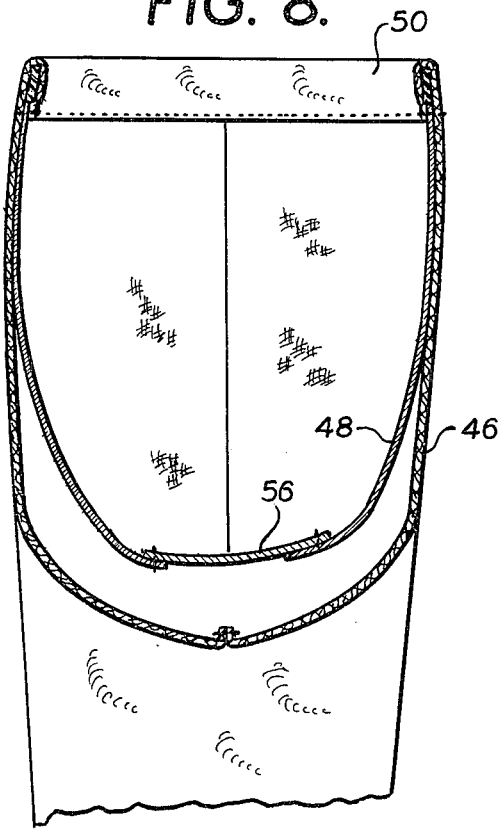
FIG. 8 is a section taken along line 8—8 of FIG. 7.
Figure 9:
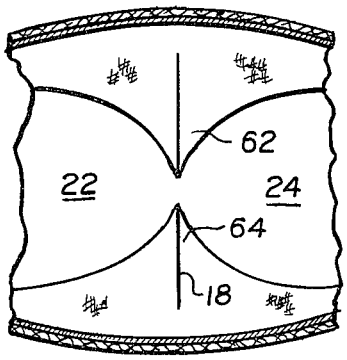
FIG. 9 is a view similar to FIG. 2 of an alternate embodiment.

In the garment of FIGS. 6, 7 and 8 the woven slacks 46 are joined to member 48 at waistband 50. Longitudinal stitch lines 52, 54 join the slacks 46 to the member 48 but these lines extend only about half-way down member 48. Accordingly, there is provided the additional anchor of crotchpiece 56 defining leg holes 58, 60. FIG. 9 shows a variation relative FIG. 2 in the area of the crotch. The front and rear of the inner member 16 are not integral nor are they actually sewn to one another. Instead the front and rear are respectively tapered at 62 and 64 substantially to points which almost meet at the crotch. The tapered sections 62, 64 are held in position by the stitch line 18. The resulting structure defines inner garment leg holes 22, 24 which lightly grasp the wearer's thighs for secure positioning.

As employed herein the term power net has reference to rubber or spandex yarn fabrics of relatively open knit or weave but it can also constitute fabrics loosely woven or knit of highly stretchable yarns which have a moderate modulus of elasticity so that, when stretched, they offer a resistance which serves the shaping purpose.

It will be appreciated that the instant specification and examples are set forth by way of illustration and not limitation, and that various modifications and changes may be made without departing from the spirit and scope of the present invention.

What is claimed is:

1. A two-layered pair of trousers comprising a continuous waistband of sufficient elasticity to be put on by the wearer, an outer trouser layer and an internal body hugging layer made of power net having front and rear sections, and means securing the outer portion to the internal portion approximately about the waistband and longitudinally downwardly from the waistband approximately centrally of at least one of the front and rear sections, the sections being tapered downwardly so as to approach but not reach one another in the crotch area and so as to define shaped partial legs holes, said downward tapering of said rear panel configuring said panel to closely fit and support the buttocks of the wearer.

2. A pair of trousers according to claim 1, wherein the internal portion is secured to the outer portion approximately centrally of the front end rear.

3. A pair of trousers according to claim 1, wherein the power net is more stretchable longitudinally than transversely.

4. A pair of trousers according to claim 3, made of stretchable fabric.

5. A pair of trousers according to claim 1, wherein the fabric is knit of textured yarn.

6. A pair of trousers according to claim 5, wherein the power net is more stretchable longitudinally than transversely.

7. A pair of trousers according to claim 6, wherein the power net is secured to the trousers approximately centrally of the front and rear of trousers.

* * * * *